US007521401B2

(12) United States Patent
Rowland

(10) Patent No.: US 7,521,401 B2
(45) Date of Patent: Apr. 21, 2009

(54) DITHIOCARBAMYL β-HYDROXY FATTY ACID ESTERS AS ADDITIVES FOR LUBRICANTS AND FUELS

(75) Inventor: Robert G. Rowland, Woodbridge, CT (US)

(73) Assignee: ChemTura Corporation, Middlebury, CT (US)

( * ) Notice: Subject to any disclaimer, the term of this patent is extended or adjusted under 35 U.S.C. 154(b) by 743 days.

(21) Appl. No.: 11/273,797

(22) Filed: Nov. 14, 2005

(65) Prior Publication Data

US 2006/0223722 A1 Oct. 5, 2006

Related U.S. Application Data

(60) Provisional application No. 60/630,543, filed on Nov. 23, 2004.

(51) Int. Cl.
*C10M 135/18* (2006.01)
*C07C 333/00* (2006.01)
*C07C 333/16* (2006.01)

(52) U.S. Cl. ..... 508/444; 558/232; 558/235; 558/236; 558/237; 558/238; 554/101; 554/102; 556/38; 562/26; 562/27; 564/18; 568/38; 568/39

(58) Field of Classification Search ..... 508/444; 558/232, 235–238; 554/101, 102; 556/38; 562/26, 27; 564/18; 568/38, 39
See application file for complete search history.

(56) References Cited

U.S. PATENT DOCUMENTS

| | | | | |
|---|---|---|---|---|
| 3,293,181 | A | 12/1966 | Stuart | |
| 3,396,109 | A | 8/1968 | Butler et al. | |
| 3,397,145 | A | 8/1968 | Cyba | |
| 3,407,222 | A | 10/1968 | Lies | |
| 3,442,804 | A | 5/1969 | Le Suer et al. | |
| 3,637,499 | A | 1/1972 | Pollak | |
| 4,758,362 | A | 7/1988 | Butke | |
| 4,885,365 | A * | 12/1989 | Lam | 544/161 |
| 5,019,284 | A | 5/1991 | Farng et al. | |
| 5,084,195 | A | 1/1992 | Camenzind et al. | |
| 5,126,063 | A | 6/1992 | Cardis et al. | |
| 5,300,243 | A | 4/1994 | Camenzind et al. | |
| 5,498,809 | A | 3/1996 | Emert et al. | |
| 5,512,190 | A | 4/1996 | Anderson et al. | |
| 5,514,189 | A | 5/1996 | Farng et al. | |
| 5,672,727 | A * | 9/1997 | Chiu | 558/236 |
| 5,698,498 | A | 12/1997 | Luciani et al. | |
| 5,789,357 | A | 8/1998 | Baranski et al. | |
| 5,872,286 | A * | 2/1999 | Baranski et al. | 562/556 |
| 6,117,826 | A | 9/2000 | Baranski et al. | |
| 6,852,680 | B2 * | 2/2005 | Gatto | 508/444 |
| 2003/0139301 | A1 | 7/2003 | Gatto | |
| 2003/0211951 | A1 | 11/2003 | Gatto | |
| 2006/0105922 | A1 * | 5/2006 | Chase et al. | 508/193 |
| 2006/0106243 | A1 * | 5/2006 | Chase et al. | 558/232 |

FOREIGN PATENT DOCUMENTS

| | | |
|---|---|---|
| EP | 1306370 A1 | 5/2003 |
| EP | 1338590 A1 | 8/2003 |

OTHER PUBLICATIONS

XP002060795, Jul. 1970, Chemical Abstracts.

* cited by examiner

*Primary Examiner*—Glenn A Caldarola
*Assistant Examiner*—Vishal Vasisth
(74) *Attorney, Agent, or Firm*—Jaimes Sher

(57) ABSTRACT

Fuels, especially hydrocarbon fuels, and lubricants, especially lubricating oils, contain dithiocarbamyl β-hydroxy fatty acid esters, a class of anti-corrosion, anti-wear, anti-fatigue, and extreme pressure additives that are derived from epoxidized fatty acid esters. The additives exhibit synergistic anti-wear activity in combination with phosphorus containing additives.

30 Claims, No Drawings

DITHIOCARBAMYL β-HYDROXY FATTY ACID ESTERS AS ADDITIVES FOR LUBRICANTS AND FUELS

CROSS REFERENCE TO RELATED APPLICATIONS

The present application claims priority to U.S. Provisional application Ser. No. 60/630,543 filed Nov. 23, 2004 which is herein incorporated by reference in its entirety.

BACKGROUND OF THE INVENTION

1. Field of the Invention

This invention is related to fuels, especially hydrocarbon fuels, and lubricants, especially lubricating oils, and, more particularly, to a class of anti-wear, anti-fatigue, and extreme pressure additives that are derived from dithiocarbamyl β-hydroxy fatty acid esters for such fuels and lubricants.

2. Description of Related Art

In developing lubricating oils, there have been many attempts to provide additives that impart anti-fatigue, anti-wear, and extreme pressure properties thereto. Zinc dialkyldithiophosphates (ZDDP) have been used in formulated oils as anti-wear additives for more than 50 years. However, zinc dialkyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the anti-wear properties of the lubricating oil.

This is a major concern as effective catalytic converters are needed to reduce pollution and to meet governmental regulations designed to reduce toxic gases such as, for example, hydrocarbons, carbon monoxide and nitrogen oxides, in internal combustion engine exhaust emissions. Such catalytic converters generally use a combination of catalytic metals, e.g., platinum or variations, and metal oxides, and are installed in the exhaust streams, e.g., the exhaust pipes of automobiles, to convert the toxic gases to nontoxic gases. As previously mentioned, these catalyst components are poisoned by the phosphorous, or the phosphorous decomposition product of the zinc dialkyldithiophosphate; and accordingly, the use of engine oils containing phosphorous additives may substantially reduce the life and effectiveness of catalytic converters. Therefore, it would be desirable to reduce the phosphorous content in the engine oils so as to maintain the activity and extend the life of the catalytic converter.

There is also governmental and automotive industry pressure towards reducing the phosphorous content. For example, United States Military Standards MIL-L-46152E at present require the phosphorous content of engine oils to be at or below 0.10 wt. %, while the ILSAC Standards defined by the Japanese and United States Automobile Industry Association at present require the phosphorous content of engine oils to be at or below 0.08 wt. %, with future phosphorous content being proposed to even lower levels. Accordingly, it would be desirable to replace or at least decrease the amount of zinc dialkyldithiophosphate in lubricating oils still further, thus reducing catalyst deactivation and hence increasing the life and effectiveness of catalytic converters while also meeting future industry standard proposed phosphorous contents in the engine oil.

In view of the aforementioned shortcomings of the known zinc and phosphorus-containing additives, efforts have been made to provide lubricating oil additives that contain neither zinc nor phosphorus or, at least, contain them in substantially reduced amounts. Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides anti-wear properties to a lubricating oil. The additive is the reaction product of 2,5-dimercapto-1,3,4-thiadiazole and a mixture of unsaturated mono-, di-, and triglycerides. Also disclosed is a lubricating oil additive with anti-wear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective anti-wear/antioxidant additives for lubricants and fuels.

U.S. Pat. Nos. 5,084,195 and 5,300,243 disclose N-acyl-thiourethane thioureas as anti-wear additives specified for lubricants or hydraulic fluids.

U.S. Pat. No. 3,407,222 discloses the reaction of ammonium dithiocarbamates of the formula:

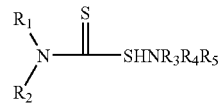

with epoxides of the formula

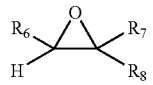

in which $R_1$, $R_2$, $R_5$, $R_6$, $R_7$ and $R_8$ are each hydrogen, alkyl, phenyl, naphthyl, cyclohexyl or phenylethyl; $R_3$ and $R_4$ are each hydrogen, alkyl; cyclohexy or phenylethyl, and wherein $R_1$ and $R_2$ as well as $R_3$ and $R_4$ taken together with the nitrogen atom in the above said dithiocarbomate salt form an heterocyclic N-moiety selected from the group consisting of pyrrolidino, piperidino and morpholino.

U.S. Pat. No. 5,019,284 teaches that alkylene oxides (epoxides) or epoxidized oils such as epoxidized soybean oil or related functionalized epoxides may be reacted with either sodium dihydrocarbyl dithiocarbamates or triethylammonium salts of dihydrocarbyl dithiocarbamates to form S-hydroxyalkyl N,N-dihydrocarbyl dithiocarbamates as generally described in the following equation:

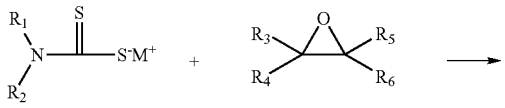

-continued

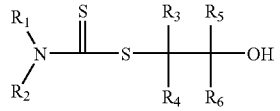

where $R_1$, $R_2$, $R_3$, $R_4$, $R_5$, and $R_6$ are hydrogen, or $C_1$ to $C_{60}$ hydrocarbyl, and can optionally contain sulfur, nitrogen and/or oxygen. The subject S-hydroxyalkyl N,N-dihydrocarbyl dithiocarbamates are not used as lubricant additives. Rather they are further reacted with dihydrocarbyl hydrogen phosphonates to prepare hydrogen phosphonate dihydrocarbyl dithiocarbamates.

U.S. Pat. No. 5,126,063 teaches the preparation of borated reaction products of metal dithiocarbamates with epoxides, and the use of these borated additives in lubricants and greases.

U.S. Pat. No. 5,698,498 discloses a lubricating composition comprising a major amount of an oil of lubricating viscosity and (A) a minor amount of at least one hydroxyalkyl dithiocarbamate or at least one borate thereof, wherein the dithiocarbamate is derived from an amine other than an alkyl or alkenylsuccinimide.

U.S. application Ser. No. 10/062,161, (US 2003/0139301) filed Oct. 26, 2001, discloses reacting alkyl glycidyl thioethers with primary and/or secondary amines and carbon disulfide to produce dithiocarbamates that are antioxidants and wear inhibitors, and that can be used in low phosphorus lubricants as a partial replacement for ZDDP.

U.S. application Ser. No. 10/067,978 (US 2003/0211951) filed Feb. 8, 2002, discloses preparation of hydroxysubstituted dithiocarbamates of the formula (1) or (2):

(1)

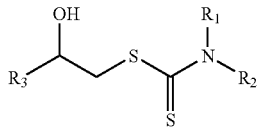

(2)

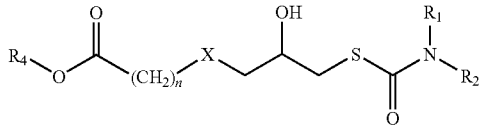

wherein $R_1$, $R_2$, and $R_4$, are alkyl, $R_3$ is alkyl or H, X is O or S, and n=1 or 2. All of the exemplified epoxides have terminal epoxide groups, e.g. epoxidized α-olefins, glycidal ethers, glycidal thioethers, and styrene oxide. This patent further discloses a composition comprising a molybdenum source, a hydroxyl-substituted dithiocarbamate, and optionally a phosphorus source.

Trofimov, B. A. et. al, *Zeitschrift fuer Chemie* (1987), 27(1), 24-5 describes the addition of various molar amounts of ammonium dithiocarbamates to 1-(2-vinyloxyethoxy)-2, 3-epoxypropane to form 2-hydroxyalkyl dithiocarbamates.

Zhang, J. et al., *Wear,* 1999 224(1) 50-55 describes the use of S-[2-S-(2-hydroxylpropyl)benzothiazole]dioctyldithiocarbamic acid ester as an additive in liquid paraffin.

SUMMARY

A composition is provided herein comprising at least one dithiocarbamyl β-hydroxy fatty acid ester having formula I or II:

(I)

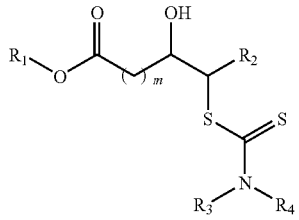

(II)

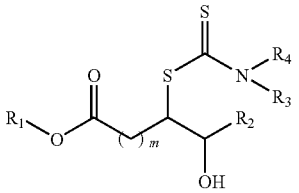

wherein m=1 to about 20, $R_1$ is a hydrocarbyl group possessing from 1 to about 50 carbon atoms with or without substituents selected from alkyl, cycloalkyl, alkenyl, aryl and alkoxy groups, and with or without heteroatoms selected from oxygen, nitrogen, and sulfur, $R_2$ is a hydrocarbyl group possessing from 1 to about 20 carbon atoms with or without olefin, dialkyldithiocarbamyl, OH, ether, oxirane, SH, or thiirane functionalities, $R_3$ and $R_4$ can be the same or different and are independently hydrocarbyl groups possessing from 1 to about 12 carbon atoms.

DESCRIPTION OF THE PREFERRED EMBODIMENTS

It has been found that dithiocarbamyl β-hydroxy fatty acid esters are useful as lubricant additives, imparting anti-wear and anti-corrosive properties to the lubricant. These dithiocarbamyl β-hydroxy fatty acid esters can be conveniently prepared by the reaction of a dithiocarbamate with an epoxidized fatty acid ester. The dithiocarbamyl β-hydroxy fatty acid esters have been found to offer anti-wear performance that is superior to that obtained from the reaction product of a dithiocarbamate with a 1-2-epoxyalkane. These dithiocarbamates derived from 1-2-epoxyalkanes have been previously disclosed in U.S. Pat. No. 5,698,498.

The desirable dithiocarbamyl β-hydroxy fatty acid esters additives of the present invention can be prepared by the reaction of an alkali metal dithiocarbamate, such as sodium dibutyl dithiocarbamate, with an epoxidized fatty acid ester. Alternatively, dithiocarbamyl β-hydroxy fatty acid esters may be prepared by the reaction of an ammonium dithiocarbamate, such as dibutylammonium dibutyldithiocarbamate with an epoxidized fatty acid ester.

Epoxidized fatty acid esters which are suitable precursors for the dithiocarbamyl β-hydroxy fatty acid esters of the present invention include epoxidized oleates, linoleates, linolenates, ricinoleates, elaidates and eleostearates. A particularly preferred class of epoxidized esters, known as epoxidized tallates, can be derived from "Tall Oil Fatty Acid", a by-product of the Kraft paper manufacturing process, composed primarily of oleic and linoleic acids. ( See "Chemical Process Technology Encyclopedia", Douglas M. Considine, Ed., McGraw Hill, New York, 1974 pp 1129-1135).

A particularly desirable, liquid, oil soluble, dithiocarbamyl β-hydroxy fatty acid ester additive can be prepared by the reaction of a sodium dibutyl dithiocarbamate with epoxidized 2-ethylhexyl tallate. Epoxidized 2-ethylhexyl tallate is an article of commerce that is available from Chemtura Corporation as Drapex® 4.4.

The present invention is directed to additives that can be used as either partial or complete replacements for the zinc dialkyldithiophosphates currently used. The additives of the present invention exhibit synergistic wear reduction when used in combination with zinc dialkyldithiophosphates. They can also be used in combination with other additives typically found in motor oils, as well as other ashless anti-wear additives. The typical additives found in motor oils include dispersants, detergents, anti-wear agents, extreme pressure agents, rust inhibitors, antioxidants, antifoamants, friction modifiers, Viscosity Index improvers, metal passivators, and pour point depressants.

The compounds employed in the practice of this invention are dithiocarbamyl β-hydroxy fatty acid esters that are useful as non-phosphorus-containing, anti-corrosion, anti-fatigue, anti-wear, extreme pressure additives for fuels and lubricating oils.

The present invention also relates to lubricating oil compositions comprising a lubricating oil and a functional property-improving amount of at least one dithiocarbamyl β-hydroxy fatty acid ester.

It is an object of the present invention to provide a new application for dithiocarbamyl β-hydroxy fatty acid esters useful either alone or in combination with other lubricant additives. The dithiocarbamyl β-hydroxy fatty acid esters in combination with zinc dialkyl dithiophosphate, zinc diaryl dithiophosphate, and/or zinc alkylaryl dithiophosphate; or in combination with ashless phophorus additives are an improvement over the prior art.

The additives of the present invention are especially useful as components in many different lubricating oil compositions. The additives can be included in a variety of oils with lubricating viscosity including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions.

The anti-fatigue, anti-wear, extreme pressure additive of the present invention includes a compound of formula I or II:

(I)

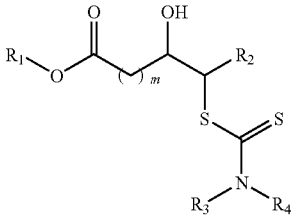

-continued (II)

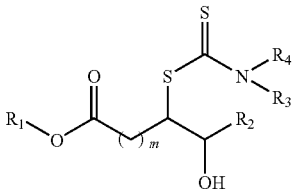

wherein m=1 to about 20, preferably 1 to about 12, $R_1$ is primarily hydrocarbyl groups of 1 to about 50, preferably 1 to about 18 carbons, which may be further substituted with alkyl, cycloalkyl, alkenyl, aryl or alkoxy groups, and may contain oxygen, nitrogen, or sulfur, $R_2$ is primarily hydrocarbyl of 1 to about 20, preferably 1 to about 12 carbons, which may contain olefin, dialkyldithiocarbamyl, OH, ether, oxirane, SH, or thiirane functionalities, and $R_3$ and $R_4$ can be the same or different and are independently hydrocarbyl groups possessing from 1 to about 12 carbon atoms.

More preferably, $R_1$ is selected from the group consisting of 1 to about 50 carbon atoms, including but not limited to linear alkyl, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, triacontyl, isomers of the foregoing, and the like; branched alkyls such as isopropyl, isobutyl, isopentyl, isohexyl, isoheptyl, isooctyl, 2-ethyl hexyl, sec-butyl, 1-methylbutyl, 1-ethylpropyl, cyclic alkyl such as cyclopropyl, cyclobutyl, cyclopentyl, cyclohexyl, cyclooctyl, and the like; aryl, alkaryl, alkoxyaryl, or alkoxyalkyl, such as phenyl, tolyl, xylyl, benzyl, methoxyphenyl, methoxylmethyl, methoxyethyl, ethoxymethyl, ethoxyethyl, and the like.

As employed herein, the term "hydrocarbyl" includes hydrocarbon as well as substantially hydrocarbon groups. "Substantially hydrocarbon" describes groups that contain heteroatom substituents that do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic substituents, aromatic-, aliphatic-, and alicyclic-substituted aromatic substituents, and the like, as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo, hydroxy, mercapto, nitro, nitroso, sulfoxy, etc.);

(3) heteroatom substituents, i.e., substituents that will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen, and such substituents as, e.g., pyridyl, furyl, thienyl, imidazolyl, etc. Preferably, no more than about 2, more preferably no more than one, hetero substituent will be present for every ten carbon atoms in the hydrocarbyl group. Most preferably, there will be no such heteroatom substituents in the hydrocarbyl group, i.e., the hydrocarbyl group is purely hydrocarbon.

As stated above, in formulas I and II described above, $R_3$ and $R_4$ are independently hydrocarbyl of from 1 to 12 carbons. Examples of $R_3$ and $R_4$ include, but are not limited to:

straight chain or branched chain alkyl or alkenyl groups including, but not limited to, methyl, ethyl, propyl, butyl, pentyl, hexyl, heptyl, octyl, 2-ethyl hexyl, nonyl, decyl, undecyl, and dodecyl, isomers of the foregoing, and the like; and cyclic alkyl groups, such as cyclopentyl, cyclohexyl, cycloheptyl, cyclooctyl, and cyclododecyl; or $R_3$ and $R_4$ may be fused together to form a ring, such as pyrrolidinyl, piperidinyl, morpholino, and the like.

More particularly, the formulas I and II above contain the fragment —O—C(O)—$(CH_2)_m$—$CHR^{11}CHR^{12}$—$R_2$ (wherein $R^{11}$ and $R^{12}$ are different and individually one or the other of —OH or —S—C(S)—$NR_3R_4$) and said fragment is preferably a residue of an epoxidized fatty acid of from 12 to 22 carbons, which may contain olefin, dialkyldithiocarbamyl, OH, ether, oxirane, SH, or thiirane functionalities.

Most preferably, the above mentioned fragment is a residue of an epoxidized oleic or an epoxidized linoleic acid ester, or mixtures thereof, including epoxidized tall oil ester, $R_1$ is alkyl or branched alkyl of 4 to 10 carbons, and $R_3$ and $R_4$ are linear or branched alkyl of 4 to 10 carbons.

Suitable epoxidized esters for use in the practice of the present invention include epoxidized methyl tallate, epoxidized butyl tallate, epoxidized 2-ethylhexyl tallate, epoxidized octyl tallate, and epoxidized methyl oleate, epoxidized butyl oleate, epoxidized 2-ethylhexyl oleate, epoxidized octyl oleate, and the like; epoxidized methyl linoleate, epoxidized butyl linoleate, epoxidized 2-ethylhexyl linoleate, epoxidized octyl linoleate and the like.

The use of the dithiocarbamyl β-hydroxy fatty acid esters of this invention can improve the anti-corrosion, anti-fatigue, anti-wear, and extreme pressure properties of a lubricant.

Especially preferred dithiocarbamyl β-hydroxy fatty acid esters additives for use in the practice of the present invention include those having the following structures (A) or (B):

(A)

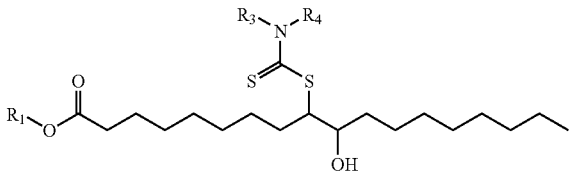

(B)

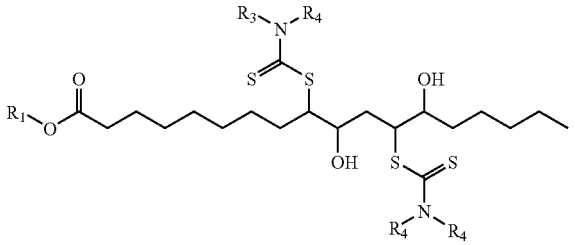

wherein:

$R_1$ is butyl, pentyl, hexyl, heptyl, 2-ethyl hexyl or octyl, and $R_3$ and $R_4$ are as described above. Preferably, $R_3$ and $R_4$ are independently butyl, pentyl, hexyl, heptyl, 2-ethyl hexyl or octyl and isomers thereof. Those skilled in the art will readily recognize that the selected structures are merely illustrative of the concept, and that a statistical mixture of hydroxyl/dithiocarbamyl substitution patterns would be expected. Those skilled in the art will also recognize that the resultant product mixture may contain unreacted epoxide (oxirane) groups, and byproducts, such as thiiranes, that are not necessarily detrimental, and may actually be beneficial to the performance of the additive mixture.

The dithiocarbamyl β-hydroxy fatty acid esters additives of this invention can be used as either a partial or complete replacement for the zinc dialkyldithiophosphates currently used, achieving a synergistic reduction in wear when used in combination with zinc dialkyldithiophosphates. They can also be used in combination with other additives typically found in lubricating oils, as well as with other antiwear additives. The additives typically found in lubricating oils are, for example, dispersants, detergents, corrosion/rust inhibitors, antioxidants, anti-wear agents, anti-foamants, friction modifiers, seal swell agents, demulsifiers, VI improvers, pour point depressants, and the like. See, for example, U.S. Pat. No. 5,498,809 for a description of useful lubricating oil composition additives, the disclosure of which is incorporated herein by reference in its entirety.

Examples of dispersants include polyisobutylene succinimides, polyisobutylene succinate esters, Mannich Base ashless dispersants, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants include alkylated diphenylamines, N-alkylated phenylenediamines, phenyl-α-naphthylamine, alkylated phenyl-α-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like. The following are exemplary of such additives and are commercially available from Chemtura Corporation: Naugalube® 438, Naugalube 438L, Naugalube 640, Naugalube 635, Naugalube 680, Naugalube AMS, Naugalube APAN, Naugard PANA, Naugalube TMQ, Naugalube 531, Naugalube 431, Naugard® BHT, Naugalube 403, and Naugalube 420, among others.

Examples of anti-wear additives that can be used in combination with the additives of the present invention include organo-borates, organo-phosphites, organo-phosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryl dithiophosphate esters, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; and from Ciba Corporation: Irgalube 353.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. The following are exemplary of molybdenum additives and are commercially available from R. T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K. K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others. Naugalube MolyFM 2543 is also exemplary of such additives and is commercially available from Chemtura Corporation.

An example of an anti-foamant is polysiloxane, and the like. Examples of rust inhibitors are polyoxyalkylene polyol, benzotriazole derivatives, and the like. Examples of viscosity index (VI) improvers include olefin copolymers and dispersant olefin copolymers, and the like. An example of a pour point depressant is polymethacrylate, and the like.

As noted above, suitable anti-wear compounds include dihydrocarbyl dithiophosphates. Preferably, the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms. The acids from which the dihydrocarbyl dithiophosphates can be derived are illustrated by acids of the formula:

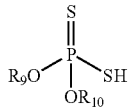

wherein $R_9$ and $R_{10}$ are the same or different and are alkyl, cycloalkyl, aralkyl, alkaryl, or substituted substantially hydrocarbyl radical derivatives of any of the above groups, and wherein the $R_9$ and $R_{10}$ groups in the acid each have, on average, at least 3 carbon atoms. By "substantially hydrocarbyl" is meant radicals containing substituent groups, e.g., 1 to 4 substituent groups per radical moiety, such as ether, ester, thio, nitro, or halogen, that do not materially affect the hydrocarbon character of the radical.

Specific examples of suitable $R_9$ and $R_{10}$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-dipentylphenyl, octylphenyl, polyisobutene-(molecular weight 350)-substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl and xenyl radicals. Alkyl radicals having from about 3 to about 30 carbon atoms and aryl radicals having from about 6 to about 30 carbon atoms are preferred. Particularly preferred $R_9$ and $R_{10}$ radicals are alkyl of from 4 to 18 carbon atoms.

The phosphorodithioic acids are readily obtainable by the reaction of phosphorus pentasulfide and an alcohol or phenol. The reaction involves mixing, at a temperature of about 20° C. to 200° C., 4 moles of the alcohol or phenol with one mole of phosphorus pentasulfide. Hydrogen sulfide is liberated as the reaction takes place. Mixtures of alcohols, phenols, or both can be employed, e.g., mixtures of $C_3$ to $C_{30}$ alcohols, $C_6$ to $C_{30}$ aromatic alcohols, etc.

The metals useful to make the phosphate salts include Group I metals, Group II metals, aluminum, lead, tin, molybdenum, manganese, cobalt, and nickel. Zinc is the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, and nickel carbonate.

In some instances, the incorporation of certain ingredients, particularly carboxylic acids or metal carboxylates, such as, small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109; and 3,442,804; the disclosures of which are hereby incorporated by reference. Also useful as anti-wear additives are amine derivatives of dithiophosphoric acid compounds, such as are described in U.S. Pat. No. 3,637,499, the disclosure of which is hereby incorporated by reference in its entirety.

The zinc salts are most commonly used as anti-wear additives in lubricating oil in amounts of 0.1 to 10, preferably 0.2 to 2, wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols can be used, including mixtures of primary and secondary alcohols, secondary generally for imparting improved antiwear properties and primary for thermal stability. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil soluble salts of dihydrocarbyl esters of dithiophosphoric acids and can be represented by the following formula:

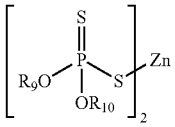

wherein $R_9$ and $R_{10}$ are as described in connection with the previous formula.

Lubricant compositions, when they contain these additives, are typically blended into a base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1-12 | 1-4 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Other esters useful as synthetic oils include those made from copolymers of $\alpha$-olefins and dicarboxylic acids which are esterified with short or medium chain length alcohols. The following are exemplary of such additives and are commercially available from Akzo Nobel Chemicals SpA: Ketjenlubes 115, 135, 165, 1300, 2300, 2700, 305, 445, 502, 522, and 6300, among others.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alpha-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples. Additives A-F are within the scope of the invention. Comparative additives G and H are not within the scope of the invention.

EXAMPLES

Additive A

N,N'-Dibutyldithiocarbamyl 2-ethylhexyl hydroxytallates

A 1000 mL 4-neck flask equipped with a mechanical stirrer, an addition funnel, a thermocouple, and a condenser with nitrogen inlet, was charged with 20.0 grams of sodium hydroxide and 34 g water. The material was stirred, and then 64.6 grams of dibutylamine was added, and the mixture stirred for 10 minutes. Carbon disulfide, 38.1 grams, was added at 25° C. over 30 minutes, Drapex® 4.4 epoxidized 2-ethylhexyl tallate (Chemtura), 170.2 grams, was added by addition funnel over 10 minutes. The reaction mixture was stirred at 50° C. for about 1 h. The reaction mixture was cooled to room temperature, ethyl acetate was added, and the mixture was brought to pH 8 by addition of 20% acetic acid. The aqueous phase was removed, and the reaction was washed twice with water. The product was dried over sodium sulfate, and then filtered. Volatiles were removed by rotary evaporation to give a clear yellow liquid.

Additive B

N,N'-dibutyldithiocarbamyl 2-ethylhexyl hydroxytallates (via trimethylammonium dibutyldithiocarbamate)

A 1000 mL 4-neck flask equipped with a mechanical stirrer, two addition funnels, a spiral condenser, and a Claisen head, a thermocouple and a nitrogen inlet was charged with 162.9 g 45% trimethylamine. Dibutylamine, 209 mL, was added dropwise from an addition funnel, maintaining temperature at 14° C. Carbon disulfide, 74.2 mL, was then added from the second addition funnel. The reaction was allowed to settle, and then separated, to yield 406.4 g clear yellow oil, with noticeable amine odor.

A 2000 mL 3-neck flask equipped with a mechanical stirrer, a thermocouple, a spiral condenser, and a nitrogen inlet and a 2.4 M HCl scrubber was charged with 405.1 g of the above, and the 571.2 mL Drapex® 4.4. The mixture was heated to 70° C. and stirred for 2 hours.

The reaction was allowed to stand over night, then taken up in 3250 mL xylenes, and extracted with 0.1 M sulfuric acid (aqueous phase pH=1). The mixture was washed four times with water, and volatiles were removed by rotary evaporation to yield 688 g amber liquid.

Additive C

N,N'-bis(2-ethylhexyl)dithiocarbamyl 2-ethylhexyl hydroxytallates

A 2 L bottom out kettle was equipped with a thermocouple, a 500 mL addition funnel, a Graham coil condenser topped with a nitrogen inlet, a heating mantle, and an overhead stirrer. The stirrer had a 4-blade Teflon paddle agitator at the bottom, and a Teflon turbine agitator 1.5 cm above the first.

The apparatus was charged with 58.84 g sodium hydroxide dissolved in 80 mL water. The beaker containing the hydroxide solution was rinsed in with two 10 mL portions of water. Bis(2-ethylhexyl) amine (354.8 g) was added from the addition funnel. A second addition funnel (250 mL) containing 112.3 g carbon disulfide was substituted for the first. Carbon disulfide was added over 135 minutes, keeping the reaction temperature between 30 and 45° C. The reaction mixture became sticky as the last 7 mL portion was added. As soon as the carbon disulfide addition was complete, Drapex® 4.4 was added from a 500 mL addition funnel (356.7 g in first charge, followed by 142.8 g additional). There was a moderate exotherm (reaction reached 61° C. after 30 minutes). The reaction cooled and was maintained at 50° C.

After 103 minutes 160 mL of 7M sulfuric of acid was added dropwise to the reaction. There was vigorous gas evolution with foaming. Agitation was stopped until foaming subsided. An additional 80 mL portion of acid was added (56° C.). There was further foaming, and agitation was again suspended. The aqueous phase was removed. Water was added. The reaction was heated to 80° C., and a portion of xylenes was added. The aqueous phase was removed. The reaction was washed with dilute acid, then dilute sodium hydroxide, and then water.

Volatiles were removed by rotary evaporation to yield 939 g of amber liquid.

Additive D

Mixed N,N'-bis(2-ethylhexyl)dithiocarbamyl 2-ethylhexyl hydroxytallates and N,N'-dioctyldithiocarbamyl 2-ethylhexyl hydroxytallates A 100 mL 3-neck flask equipped with a mechanical stirrer, a thermocouple and a condenser with nitrogen inlet was charged with 3.196 g sodium hydroxide and 9 mL water. Dioctylamine, 12.0 mL (9.6 g) was added, followed by 12.0 mL (9.6 g) bis(2-ethylhexyl)amine. Carbon disulfide, 4.8 mL (6.1 g), was added slowly by syringe. The mixture warmed to 45° C. during the addition. The mixture became a sticky mass at the end of the reaction. Drapex® 4.4 was added, 29.5 mL, (27.1 g), and the reaction was heated to 70° C. There was a significant exotherm. The reaction mass reached 80° C. followed by 5.6 mL (7.1 g) carbon disulfide. The mixture became very viscous. The reaction mass was held at 70° C. for 4 hours.

The reaction was taken up in 100 mL xylenes, and 100 mL water was added, followed by 7.0 mL glacial acetic acid. The aqueous layer was removed, and the organic layer was washed with three 100 mL portions of water. Volatiles were removed by rotary evaporation to yield 46.56 g clear yellow liquid.

Additive E

Dioctyldithiocarbamyl 2-ethylhexyl tallate

A 100 mL 3-neck flask equipped with a mechanical stirrer, a thermocouple and a condenser with nitrogen inlet was charged with 3.194 g sodium hydroxide and 9 mL water. Dioctylamine, 24.1 mL (19.3 g) was added. Carbon disulfide, 4.8 mL (6.1 g), was added slowly by syringe. The mixture warmed to 50° C. during the addition. The mixture became a sticky mass at the end of the reaction. Drapex® 4.4 was added, 29.5 mL, (27.1 g), and the reaction was heated to 70° C. for 0.6 hours.

The reaction was taken up in 100 mL xylenes, and 100 mL water was added, followed by 7.0 mL glacial acetic acid. The aqueous layer was removed, and the organic layer was washed with three 100 mL portions of water. Volatiles were removed by rotary evaporation to yield 46.73 g clear amber liquid.

Additive F

Diamyldithiocabamyl 2-ethylhexyl tallate

A 100 mL 3-neck flask equipped with a mechanical stirrer, a thermocouple and a condenser with nitrogen inlet was charged with 3.202 g sodium hydroxide and 9 mL water. Diamylamine, 16.2 mL (12.58 g) was added. Carbon disulfide 4.8 mL (6.1 g), was added slowly by syringe. The mixture became a sticky mass at the end of the reaction. Drapex® 4.4 was added, 34.0 mL, (31.3 g), and the reaction was heated to 70° C. and held there for 3 hours.

The reaction was taken up in 100 mL xylenes, and 100 mL water was added, followed by 6.0 mL glacial acetic acid. The aqueous layer was removed, and the organic layer was washed with two mL portions of water. Volatiles were removed by rotary evaporation to yield 41.97 g clear yellow liquid.

Comparative Additive G

S-[1-(2-hydroxyhexadecyl)]-N,N'-dipentyldithiocarbamate

A 100 mL 4-neck flask equipped with a mechanical stirrer, an addition funnel, a thermocouple and a condenser with nitrogen inlet was charged with 32.6 g 1,2-epoxyhexadecane (Aldrich) and 10.8 g carbon disulfide. Dipentyl amine (Aldrich) was added dropwise over 30 min. The reaction temperature did not exceed 30° C. The reaction was stirred for 1 hour at 23-26° C. for 1.0 hour, and then heated to 65° C. for 2.0 hours. Volatiles were removed by rotary evaporation to yield a yellow oil.

Comparative Additive H

S-[1-(2-hydroxcyclohexyl)]-N,N'-dibutyldithiocarbamate

A 100 mL 4-neck flask equipped with a mechanical stirrer, an addition funnel, a thermocouple and a condenser with nitrogen inlet was charged with 3.71 g sodium hydroxide and 10 mL water. Dibutylamine, 15.7 mL was added, followed by 5.6 mL carbon disulfide. The mixture became very viscous. Temperature was increased to 48° C. Cyclohexene oxide, 9.40 mL was added slowly. Temperature increased to 70° C. The reaction was stirred at 67° C. for 2.5 h. The reaction mixture was taken up in heptanes, washed with water, and the aqueous phase was removed. The reaction mixture was extracted with acetic acid, and dried over magnesium sulfate. The product was filtered, and volatiles were removed by rotary evaporation to yield a yellow oil.

Examples 1-9

The following examples demonstrate the efficacy of the dithiocarbamyl β-hydroxy fatty acid esters as lubricant additives. The examples also demonstrate the superior anti-wear protection that is offered by the additives prepared from epoxidized fatty esters (Additives A-F) vs. those comparative additives prepared from epoxidized olefins (Comparative Additives G, H). The dithiocarbamyl β-hydroxy fatty acid esters also show a synergistic effect with zinc dialkyldithiophosphate (ZDDP). In addition, the dithiocarbamyl β-hydroxy fatty acid esters show no harm in corrosion testing.

Anti-Wear Four-Ball Testing

The anti-wear properties of the dithiocarbamyl β-hydroxy fatty acid esters in a fully formulated American Petroleum Institute (API) Group II lubricating oil were determined in the Four-Ball Wear Test under the ASTM D 4172 test conditions. The testing for these examples was done on a Falex Variable Drive Four-Ball Wear Test Machine. Four balls are arranged in an equilateral tetrahedron. The lower three balls are clamped securely in a test cup filled with lubricant and the upper ball is held by a chuck that is motor-driven. The upper ball rotates against the fixed lower balls. Load is applied in an upward direction through a weight/lever arm system. Loading is through a continuously variable pneumatic loading system. Heaters allow operation at elevated oil temperatures. The three stationary steel balls are immersed in 10 milliliters of sample to be tested, and the fourth steel ball is rotated on top of the three stationary balls in "point-to-point contact." The machine is operated for one hour at 75° C. with a load of 40 kilograms and a rotational speed of 1,200 revolutions per minute. The fully formulated lubricating oil contained all the additives typically found in a motor oil (with different anti-wear agents as noted in TABLE 2) as well as 0.5 wt. % cumene hydroperoxide to help simulate the environment within a running engine. The additives were tested for effectiveness in a motor oil formulation and compared to identical formulations with and without any zinc dialkyldithiophosphate. The wear scar decreases with increasing effectiveness of the lubricant composition. The number of averaged tests averaged together to provide the wear scar data are given in the column (#x).

TABLE 2

Four Ball Wear Test

| Example # | AW Additive | % Additive in Blend | Wear Scar (mm) | (#x) |
|---|---|---|---|---|
| 1 | Additive A | 1.00% | 0.433 | 4 |
| 2 | Additive A | 0.50% | 0.430 | 2 |
| | ZDDP | 0.50% | | |
| 3 | Additive B | 1.00% | 0.696 | 4 |
| 4 | Additive C | 1.00% | 0.447 | 2 |
| 5 | Additive D | 1.00% | 0.496 | 2 |
| 6 | Additive E | 1.00% | 0.364 | 2 |
| 7 | Additive F | 1.00% | 0.379 | 2 |
| 8 | Comparative Additive G | 1.00% | 0.758 | 2 |
| 9 | Comparative Additive H | 1.00% | 0.690 | 2 |

As can be seen from TABLE 2, Additives A to F either alone (Examples 1, and 3-7) or in combination with ZDDP (Example 2) generally provided lower wear scar than the comparative additives G and H.

Anti-Wear Cameron-Plint TE77 High Frequency Friction Machine Testing

The anti-wear properties of the additives of this invention in a fully formulated API Group II lubricating oil were determined in the Cameron-Plint TE77 High Frequency Friction Machine Test. The specimen parts (6 mm diameter AISI 52100 steel ball of 800±20 kg/mm$^2$ hardness and hardened ground NSOH B01 gauge plate of RC 60/0.4 micron) were rinsed and then sonicated for 15 minutes with technical grade hexanes. This procedure was repeated with isopropyl alcohol. The specimens were dried with nitrogen and set into the TE77. The oil bath was filled with 10 mL of sample. The test was run at a 30 Hertz frequency, 100 Newton load, 2.35 mm amplitude. The test starts with the specimens and oil at room temperature. Immediately, the temperature was ramped over 15 minutes to 50° C., where it dwelled for 15 minutes. The temperature was then ramped over 15 minutes to 100° C., where it dwelled at 100° C. for 45 minutes. A third temperature ramp over 15 minutes to 150° C. was followed by a final dwell at 150° C. for 15 minutes. The total length of the test was 2 hours. At the end of test, the wear scar diameter on the 6 mm ball was measured using a Leica StereoZoom6® Stereomicroscope and a Mitutoyo 164 series Digimatic Head. The fully formulated lubricating oils tested contained 1 weight % cumene hydroperoxide to help simulate the environment within a running engine. The additives were tested for effectiveness in motor oil formulations and compared to identical formulations with and without any zinc dialkyldithiophosphate. In TABLE 3 the numerical value of the test results (Wear Scar Diameter, mm) decreases with an increase in effectiveness. Also determined was the maximum depth of the wear scar on the plate. This is measured using a profilimeter (μm). Blends designated as B-1, B-2 and B-3 were tested.

TABLE 3

Cameron-Plint Wear Test

| Additive | Avg. Ball Scar (mm) | Avg. Plate Scar Width (mm) | Avg. Plate Scar Depth (μm) | Blend Designation |
|---|---|---|---|---|
| Additive A | 0.7215 | 0.2718 | 1.9708 | B-1 |
| Additive A | 0.7875 | 0.1750 | 2.1755 | B-1 |

TABLE 3-continued

Cameron-Plint Wear Test

| Additive | | Avg. Ball Scar (mm) | Avg. Plate Scar Width (mm) | Avg. Plate Scar Depth (μm) | Blend Designation |
|---|---|---|---|---|---|
| Additive A | 0.50% | 0.4330 | 0.4183 | 2.0680 | B-2 |
| ZDDP | 0.50% | | | | |
| Additive A | 0.50% | 0.4630 | 0.3245 | 2.1628 | B-3 |
| ZDDP | 0.50% | | | | |

Pb & Cu Corrosion Testing

In TABLE 4 are the results of a Cummins bench test for measuring the degree of Cu and Pb corrosion of an oil formulation. The Cummins bench test is part of the API CH-4 category for diesel engine oils. Four metal coupons (25.4 mm squares) of pure lead, copper, tin, and phosphor-bronze are immersed in 100 mL of oil at 121° C. with air bubbling through (5 L/hr) for 168 hours. The used oil is analyzed for metals and the copper sample is examined for discoloration. The limits for API CH-4 are 20 ppm Cu, 120 ppm Pb, 50 ppm Sn in used oil and 3 max for the ASTM D 130 rating of the copper square. Additives were blended into a fully formulated SAE 15W-40 oil with ILSAC GF-2 credentials. In the first row of TABLE 4 are data generated on the SAE 15W-40 oil without any top treat of other additives. The dithiocarbamyl β-hydroxy fatty acid did very well on Pb corrosion with passing results. Blends designated as B-4, B-5, B-6 and B-7 were tested. Blend B-4 contained no additive and was used as a reference.

TABLE 4

ASTM D 5968 Corrosion Bench Test of Engine Oil at 121° C.

| Blend Designation | Additive (in Rotella T SAE 15W-40) | Wt % Additive | Cu ppm | Pb ppm | ASTM D130 |
|---|---|---|---|---|---|
| B-4 | Reference | 0.0 | 7 | 11.9 | 1b |
| B-5 | Example A | 1.0 | 14 | 3.1 | 1b |
| B-6 | Example A | 1.0 | 16 | 2.2 | 1b |
| B-7 | Example A | 1.0 | 14 | 1.9 | 1b |

In view of the many changes and modifications that can be made without departing from principles underlying the invention, reference should be made to the appended features for an understanding of the scope of the protection to be afforded the invention.

What is claimed is:

1. A composition comprising at least one dithiocarbamyl β-hydroxy fatty acid ester having formula I or II:

(I)

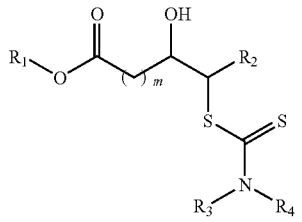

-continued (II)

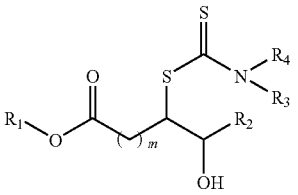

wherein m=1 to about 20, $R_1$ is a hydrocarbyl group possessing from 1 to about 50 carbon atoms with or without substituents selected from alkyl, cycloalkyl, alkenyl, aryl and alkoxy groups, and with or without heteroatoms selected from oxygen, nitrogen, and sulfur, $R_2$ is a hydrocarbyl group possessing from 1 to about 20 carbon atoms with or without olefin, dialkyldithiocarbamyl, OH, ether, oxirane, SH, or thiirane functionalities, $R_3$ and $R_4$ can be the same or different and are independently hydrocarbyl groups possessing from 1 to about 12 carbon atoms.

2. The composition of claim 1 wherein m is from 1 to about 12, $R_1$ possesses from 1 to about 18 carbon atoms, and $R_2$ possesses from 1 to about 12 carbon atoms.

3. The composition of claim 1 wherein $R_1$ is selected from the group consisting of methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, triacontyl, isopropyl, isobutyl, isopentyl, isohexyl, isoheptyl, isooctyl, 2-ethyl hexyl, sec-butyl, 1-methylbutyl, 1-ethylpropyl, cyclopropyl, cyclobutyl, cyclopentyl, cyclohexyl, cyclooctyl, phenyl, tolyl, xylyl, benzyl, methoxyphenyl, methoxylmethyl, methoxyethyl, ethoxymethyl, ethoxyethyl and isomers thereof.

4. The composition of claim 1 wherein $R_3$ and $R_4$ are alkyl groups fused together to form a ring with or without N, O, or S, and with or without alkyl, alkenyl, aryl, or alkoxy substituents.

5. The composition of claim 1 wherein the dithiocarbamyl β-hydroxy fatty acid ester having formula I or II is prepared by the reaction of an alkali metal dithiocarbamate or an ammonium dithiocarbamate with an epoxidized fatty acid ester.

6. The composition of claim 1 wherein the dithiocarbamyl β-hydroxy fatty acid ester of formula (I) and (II) is prepared by the reaction of an alkali metal dithiocarbamate or an ammonium dithiocarbamate with an epoxidized oleic acid ester, or an epoxidized linoleic acid ester, or a mixture thereof.

7. The composition of claim 1 wherein the dithiocarbamyl β-hydroxy fatty acid ester of formula (I) and (II) is prepared by the reaction of an alkali metal dithiocarbamate or an ammonium dithiocarbamate with a tallate ester.

8. The composition of claim 1 wherein the dithiocarbamyl β-hydroxy fatty acid ester of formula (I) and (II) is prepared by the reaction of an alkali metal dithiocarbamate or an ammonium dithiocarbamate with a 2-ethylhexyl tallate ester.

9. The composition of claim 1 wherein the dithiocarbamyl β-hydroxy fatty acid ester has one of the following structures (A) or (B), or isomers thereof:

(A)

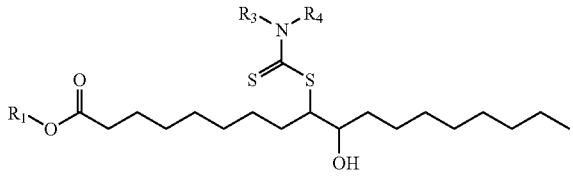

(B)

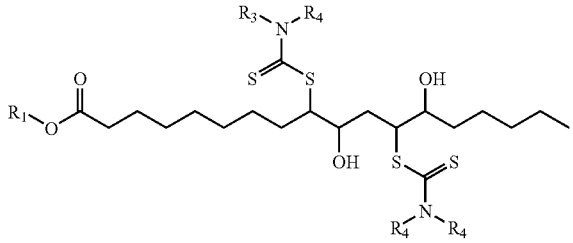

wherein:

$R_1$ is butyl, pentyl, hexyl, heptyl, 2-ethyl hexyl, or octyl, and $R_3$ and $R_4$ are independently butyl, pentyl, hexyl, heptyl, octyl, or 2-ethyl hexyl.

10. A composition comprising:

a) an oil of lubricant viscosity; and b) at least one dithiocarbamyl β-hydroxy fatty acid ester having formula I or II:

(I)

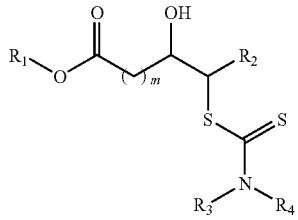

(II)

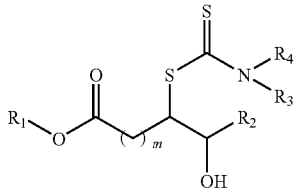

wherein m=1 to about 20, $R_1$ is a hydrocarbyl group possessing from 1 to about 50 carbon atoms with or without substituents selected from alkyl, cycloalkyl, alkenyl, aryl and alkoxy groups, and with or without heteroatoms selected from oxygen, nitrogen, and sulfur, $R_2$ is a hydrocarbyl group possessing from 1 to about 20 carbon atoms with or without olefin, dialkyldithiocarbamyl, OH, ether, oxirane, SH, or thiirane functionalities, $R_3$ and $R_4$ can be the same or different and are independently hydrocarbyl groups possessing from 1 to about 12 carbon atoms.

11. The composition of claim 10 wherein m is from 1 to about 12, $R_1$ possesses from 1 to about 18 carbon atoms, and $R_2$ possesses from 1 to about 12 carbon atoms.

12. The composition of claim 10 wherein $R_1$ is selected from the group consisting of methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, triacontyl, isopropyl, isobutyl, isopentyl, isohexyl, isoheptyl, isooctyl, 2-ethyl hexyl, sec-butyl, 1-methylbutyl, 1-ethylpropyl, cyclopropyl, cyclobutyl, cyclopentyl, cyclohexyl, cyclooctyl, phenyl, tolyl, xylyl, benzyl, methoxyphenyl, methoxylmethyl, methoxyethyl, ethoxymethyl, ethoxyethyl and isomers thereof.

13. The composition of claim 10 wherein $R_3$ and $R_4$ are alkyl groups fused together to form a ring with or without N, O, or S, and with or without alkyl, alkenyl, aryl, or alkoxy substituents.

14. The composition of claim 10 wherein the dithiocarbamyl β-hydroxy fatty acid ester having formula I or II is prepared by the reaction of an alkali metal dithiocarbamate or an ammonium dithiocarbamate with an epoxidized fatty acid ester.

15. The composition of claim 10 wherein the dithiocarbamyl β-hydroxy fatty acid ester of formula (I) and (II) is prepared by the reaction of an alkali metal dithiocarbamate or an ammonium dithiocarbamate with an epoxidized oleic acid ester, or an epozidized linoleic acid ester, or a mixture thereof.

16. The composition of claim 10 wherein the dithiocarbamyl β-hydroxy fatty acid ester of formula (I) and (II) is prepared by the reaction of an alkali metal dithiocarbamate or an ammonium dithiocarbamate with a tallate ester.

17. The composition of claim 10 wherein the dithiocarbamyl β-hydroxy fatty acid ester of formula (I) and (II) is prepared by the reaction of an alkali metal dithiocarbamate or an ammonium dithiocarbamate with a 2-ethylhexyl tallate ester.

18. The composition of claim 10 wherein the dithiocarbamyl β-hydroxy fatty acid ester has one of the following structures (A) or (B), or isomers thereof:

(A)

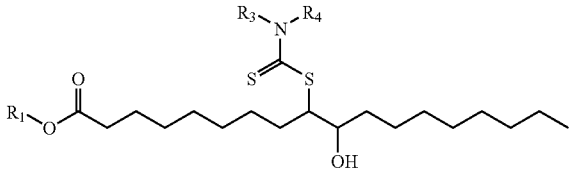

(B)

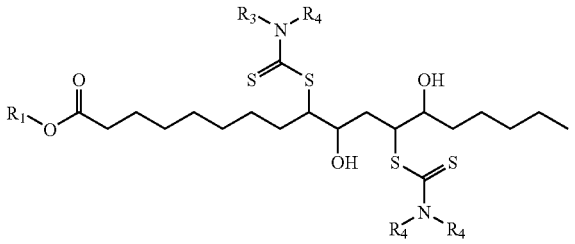

wherein:

$R_1$ is butyl, pentyl, hexyl, heptyl, 2-ethyl hexyl, or octyl, and $R_3$ and $R_4$ are independently butyl, pentyl, hexyl, heptyl, octyl, or 2-ethyl hexyl.

19. The composition according to claim 10, further containing a zinc dihydrocarbyldithiophosphate.

20. The composition of claim 10 further containing one or more additives selected from the group consisting of:

at least one dispersant selected from the group consisting of polyisobutylene succinimides, polyisobutylene succinate esters and Mannich Base ashless dispersants, at least one detergent selected from the group consisting of metallic and ashless alkyl phenates, metallic and ashless sulfurized alkyl phenates, metallic and ashless alkyl sulfonates, metallic and ashless alkyl salicylates, and metallic and ashless saligenin derivatives, at least one antioxidant selected from the group consisting of alkylated diphenylamines, N-alkylated phenylenediamines, phenyl-α-naphthylamine, alkylated phenyl-α-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives and oil soluble copper compounds, at least one anti-wear additive selected from the group consisting of organo borates, organo-phosphites, organo-phosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryl dithiophosphate esters and phosphosulfurized hydrocarbons, at least one friction modifier selected from the group consisting of fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates and non-sulfur molybdenum compounds, at least one polysiloxane anti-foamant, at least one rust inhibitor selected from the group consisting of polyoxyalkylene polyol and benzotriazole derivatives, at least one viscosity index improver selected from the group consisting of olefin copolymers and dispersant olefin copolymers and at least one polymethacrylate pour point depressant.

21. The composition of claim 10 wherein the oil of lubricant viscosity is a natural or synthetic lubricating oil base stock fraction having a kinematic viscosity at 100° C. of about 2 to about 200 cSt.

22. A composition comprising:

a) a hydrocarbon fuel; and b) at least one dithiocarbamyl β-hydroxy fatty acid ester having formula I or II:

(I)

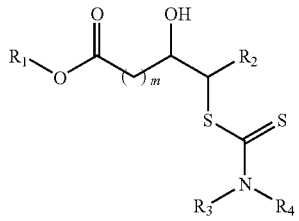

(II)

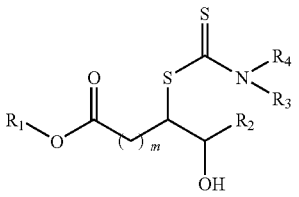

wherein m=1 to about 20, $R_1$ is a hydrocarbyl group possessing from 1 to about 50 carbon atoms with or without substituents selected from alkyl, cycloalkyl, alkenyl, aryl and alkoxy groups, and with or without heteroatoms selected from oxygen, nitrogen, and sulfur, $R_2$ is a hydrocarbyl group possessing from 1 to about 20 carbon atoms with or without olefin, dialkyldithiocarbamyl, OH, ether, oxirane, SH, or thiirane functionalities, $R_3$ and $R_4$ can be the same or different and are independently hydrocarbyl groups possessing from 1 to about 12 carbon atoms.

23. The composition of claim 22 wherein m is from 1 to about 12, $R_1$ possesses from 1 to about 18 carbon atoms, and $R_2$ possesses from 1 to about 12 carbon atoms.

24. The composition of claim 22 wherein $R_1$ is selected from the group consisting of methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, triacontyl, isopropyl, isobutyl, isopentyl, isoheptyl, isooctyl, sec-butyl, 1-methylbutyl, 1-ethylpropyl, cyclopropyl, cyclobutyl, cyclopentyl, cyclohexyl, cyclooctyl, phenyl, tolyl, xylyl, benzyl, methoxyphenyl, methoxylmethyl, methoxyethyl, ethoxymethyl, ethoxyethyl and isomers thereof.

25. The composition of claim 22 wherein $R_3$ and $R_4$ are alkyl groups fused together to form a ring with or without N, O, or S, and with or without alkyl, alkenyl, aryl, or alkoxy substituents.

26. The composition of claim 22 wherein the dithiocarbamyl β-hydroxy fatty acid ester having formula I or II is prepared by the reaction of an alkali metal dithiocarbamate or an ammonium dithiocarbamate with an epoxidized fatty acid ester.

27. The composition of claim 22 wherein the dithiocarbamyl β-hydroxy fatty acid ester of formula (I) and (II) is prepared by the reaction of an alkali metal dithiocarbamate or an ammonium dithiocarbamate with an epoxidized oleic acid ester, or an epozidized linoleic acid ester, or a mixture thereof.

28. The composition of claim 22 wherein the dithiocarbamyl β-hydroxy fatty acid ester of formula (I) and (II) is prepared by the reaction of an alkali metal dithiocarbamate or an ammonium dithiocarbamate with a tallate ester.

29. The composition of claim 22 wherein the dithiocarbamyl β-hydroxy fatty acid ester of formula (I) and (II) is prepared by the reaction of an alkali metal dithiocarbamate or an ammonium dithiocarbamate with a 2-ethylhexyl tallate ester.

30. The composition of claim 22 wherein the dithiocarbamyl β-hydroxy fatty acid ester has one of the following structures, or isomers thereof:

(A)

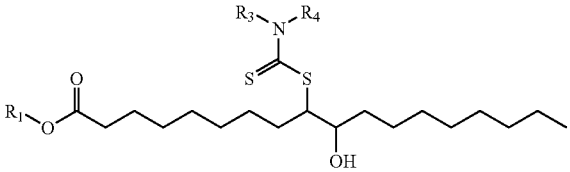

(B)

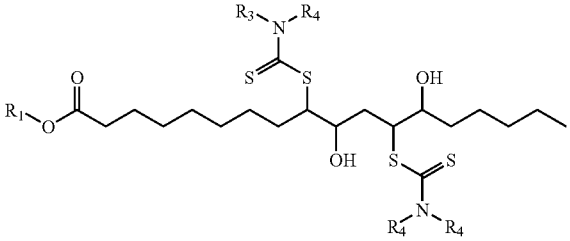

wherein:

$R_1$ is butyl, pentyl, hexyl, heptyl, 2-ethyl hexyl, or octyl, and $R_3$ and $R_4$ are independently butyl, pentyl, hexyl, heptyl, octyl, or 2-ethyl hexyl.

* * * * *